US008257146B2

(12) United States Patent
Antolotti et al.

(10) Patent No.: US 8,257,146 B2
(45) Date of Patent: Sep. 4, 2012

(54) PROCESS FOR SURFACE PREPARATION OF PARTS TO BE COATED

(75) Inventors: Nelso Antolotti, Varano Melegari (IT); Andrea Scrivani, Piacenza (IT); Gabriele Rizzi, Piacenza (IT); Dario Russo, Colorno (IT)

(73) Assignee: Turbocoating S.p.A., Solignano (PR) (IT)

( * ) Notice: Subject to any disclaimer, the term of this patent is extended or adjusted under 35 U.S.C. 154(b) by 577 days.

(21) Appl. No.: 12/515,472

(22) PCT Filed: Nov. 12, 2007

(86) PCT No.: PCT/EP2007/062232

§ 371 (c)(1), (2), (4) Date: May 19, 2009

(87) PCT Pub. No.: WO2008/061911

PCT Pub. Date: May 29, 2008

(65) Prior Publication Data

US 2010/0081364 A1 Apr. 1, 2010

(30) Foreign Application Priority Data

Nov. 22, 2006 (IT) ..... PR2006A0103

(51) Int. Cl.
*B24C 1/00* (2006.01)

(52) U.S. Cl. ..... 451/37; 451/39; 451/57

(58) Field of Classification Search ..... 451/54, 451/36, 37, 57, 59
See application file for complete search history.

(56) References Cited

U.S. PATENT DOCUMENTS

| | | | | |
|---|---|---|---|---|
| 3,833,414 | A | 9/1974 | Grisik et al. | |
| 4,287,740 | A | 9/1981 | Kumar | |
| 5,312,520 | A * | 5/1994 | Chung | 134/7 |
| 5,372,652 | A | 12/1994 | Srikrishnan et al. | |
| 5,527,203 | A * | 6/1996 | Cook et al. | 451/38 |
| 2002/0098776 | A1 * | 7/2002 | Dopper | 451/2 |
| 2004/0050818 | A1 | 3/2004 | Duval | |
| 2004/0178178 | A1 * | 9/2004 | Blohowiak et al. | 216/89 |
| 2005/0014453 | A1 * | 1/2005 | Mayer et al. | 451/38 |
| 2005/0055820 | A1 | 3/2005 | Nowaczyk | |
| 2006/0099888 | A1 * | 5/2006 | Ishibashi et al. | 451/38 |

OTHER PUBLICATIONS

International Search Report dated Feb. 25, 2008, from corresponding PCT application.

* cited by examiner

*Primary Examiner* — Dung Van Nguyen
(74) *Attorney, Agent, or Firm* — Young & Thompson

(57) ABSTRACT

A process for surface preparation of parts to be coated using Thermal Spray or Cold Spray technologies, which is the result of a step in which the relevant surface is abraded by steel-based abrasive material, and later washing off of any residue thereof.

4 Claims, 1 Drawing Sheet

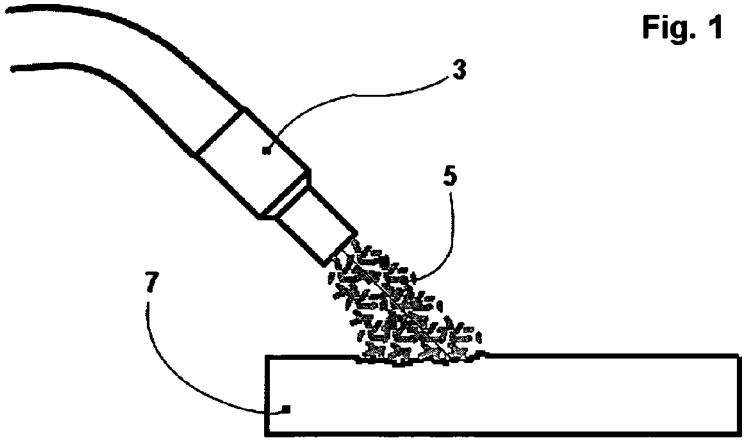
Fig. 1
FIG. 2
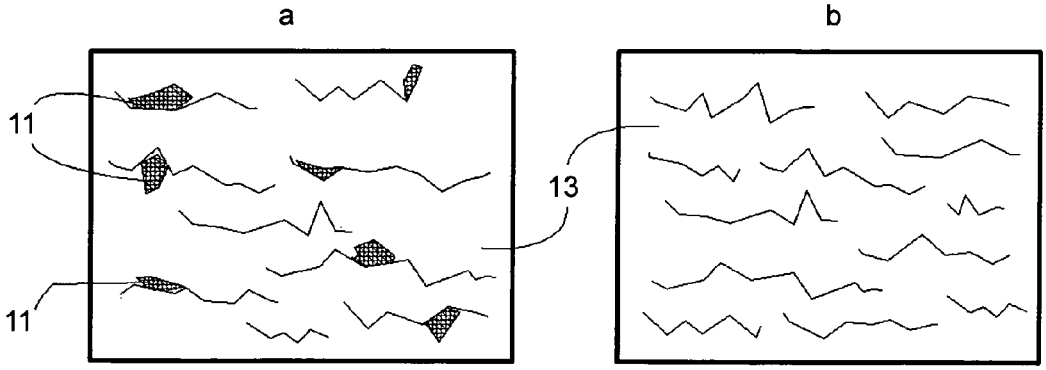
FIG. 3
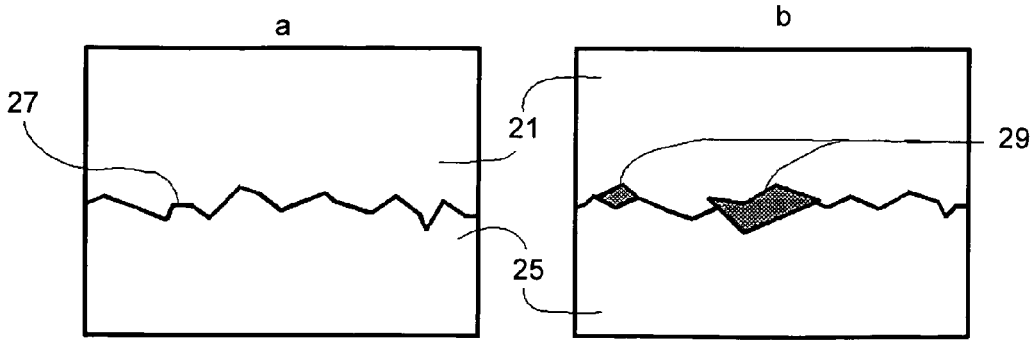

PROCESS FOR SURFACE PREPARATION OF PARTS TO BE COATED

FIELD OF THE INVENTION

The present invention relates to a process for surface preparation of parts to be coated, namely parts to be coated using Thermal Spray or Cold Spray technologies and typically for metal parts that are required to be wear-, corrosion- and heat-resistant.

Particularly, the present invention relates to the process for surface preparation of parts, i.e. the materials, coating parameters and procedures used in such treatment, for improved adhesion between the treated surface and the coating applied thereon.

BACKGROUND OF THE INVENTION

Typically, prior art provides abrasive blasting, to increase surface roughness of the surface to be coated.

Blasting is mainly carried out by dry techniques (using compressed air as a carrier fluid) and wet techniques (using water as a carrier fluid) with abrasive particles of various sizes, e.g. corundum and silicon carbide particles.

Increased roughness is obtained by mechanical removal of material from the surface by the abrasive particles impinging thereon.

As a result of this, when corundum is used, a certain number of particles can penetrate the treated surface, thereby weakening the adhesion of the overlying coating whereas, when using silicon carbide, particles tend to decompose during later treatments or during operation of the blasted part, for example, in the case of gas turbine (rotor or stator) parts, during operation of the turbine, with possible formation of low-melting eutectic compounds of Ni and Si or bubbles produced by the combination of carbon with oxygen to form carbon oxide or dioxide.

SUMMARY OF THE INVENTION

The object of the present invention is to provide a treatment, i.e. a process for surface preparation of the rough surfaces of parts to be coated using technologies such as:

Air Plasma Spray (plasma spraying in air)

Vacuum Plasma Spray (plasma spraying under vacuum)

High Velocity Oxygen Fuel (high velocity by oxygen combustion)

Cold Spray (cold spraying)

It shall be noted that the explanations in parentheses are literally descriptive, whereas the terms are proper names that uniquely define the respective technologies.

Particularly, this invention provides a combination of materials, coating parameters and procedures that led to an ideal surface for coating anchorage: optimal roughness with no element foreign to the matrix of the base material, i.e. abrasive grains.

The advantages achieved thanks to the inventive process include:

optimal roughness of the treated surface;

no foreign material, e.g. no abrasive particles trapped therein.

This improves the adhesion properties of the coating on the surface of the material, thereby increasing corrosion- and heat oxidation-resistance of parts, e.g. in gas turbines and aircraft engines.

Furthermore, the present process is characterized by a low sensitivity to operating parameters, i.e. to any changes to the operating procedure made by the operator.

This leads to a higher efficiency and to a minimized number of non optimal treatments.

The above objects and advantages are achieved by the method for making the surface finish, the morphology obtained thereby and the parts coated therewith according to this invention, which is characterized as set out in the annexed claims.

BRIEF DESCRIPTION OF THE DRAWINGS

These and other features will be more apparent from the following description of a few embodiments, which are shown by way of example and without limitation in the accompanying drawings, in which:

FIG. 1 shows a step of the treatment process of the invention, and particularly the step of dry blasting using iron-based abrasive material.

FIG. 2 is a detail view of surfaces blasted using the present method (a) and the standard corundum-based method (b).

FIG. 3 shows two sections of parts coated and heat-treated after surface preparation with the present method (a) and the conventional method (b).

DETAILED DESCRIPTION OF THE INVENTION

Particularly referring to FIG. 1, numeral 3 designates the equipment used for generating a pressurized flow 5 of abrasive material which impinges on the surface of the part to be treated 7 with a varying angle of incidence.

The scope of the present invention encompasses both the part 7 whose surface is treated as claimed below, and the treatment process to obtain a zero-pollution rough surface after a blast cleaning cycle with the method as disclosed below.

The process of the invention first includes the step of treating the surface with an iron-based abrasive material, such as high chromium stainless steel, with a varying angle of incidence on the surface and a varying blowing pressure.

After said blasting step, the part is dipped in an acid solution to disaggregate any abrasive material remaining after blasting.

Otherwise, instead of being dipped, the part may be sprayed with the acid solution.

The next step includes the use of a basic solution such as caustic soda, to neutralize the acid solution remaining on the previously exposed surface.

The procedure is completed by the step of rinsing the part 7 with distilled water to remove the basic solution thereby clearing the treated surface of any foreign material.

Particularly referring to FIG. 2, there are shown two enlarged views of surfaces treated with the conventional method (a) and with the present method (b), where the former shows particles (11) implanted on the surface of the material 13, unlike the present method, in which the treated surface 13 includes no foreign material.

Particularly referring to FIG. 3, there are shown two sections of parts processed with the present method a and with the conventional method b.

It shall be noted that, in section (a), the interface between the base material 25 and the coating 21, in this case a metal coating, provides perfect adhesion, with an even interdiffusion area 27 after heat treatment.

However, in section (b), cavities 29 are found in the interface area, due to the corundum particles implanted on the surface of the base material and removed upon polishing of the specimen.

The invention claimed is:

1. A process for surface preparation of mechanical parts to be coated with thermal spray technologies, comprising:

a. treating the surface of the part with an iron-based abrasive material, b. washing said part with an acid solution to disaggregate and/or remove any remaining abrasive material, c. applying a basic solution comprising caustic soda to neutralize any remaining acid solution on the treated surface of the part, d. rinsing the part with distilled water to remove the caustic soda, thereby clearing the treated surface of any foreign material, and e. removing any liquid remaining on the surface by blowing pressurized air thereon or by utilizing a centrifugal effect of a rotary carousel, wherein, said iron-based abrasive material has a spherical morphology and is applied by a pressurized flow impinging on the surface of the part with a varying angle of incidence and a varying blowing pressure, and said treated surface of the part is coated by a coating technology.

2. The process as claimed in claim 1, wherein the step of washing said part with an acid solution is carried out by dipping or spraying.

3. The process as claimed in claim 1, wherein said abrasive material is high chromium stainless steel.

4. The process as claimed in claim 1, wherein the rinsing the part step is carried out with acetone, alcohol or any cleansing and volatile agent that can be easily removed thereby leaving a minimal amount of residues.

* * * * *